United States Patent [19]

Raybould

[11] 4,313,759

[45] Feb. 2, 1982

[54] WEAR RESISTANT ALUMINIUM ALLOY

[75] Inventor: Derek Raybould, Préverenges, Switzerland

[73] Assignee: Institut Cerac S.A., Ecublens, Switzerland

[21] Appl. No.: 169,317

[22] Filed: Jul. 16, 1980

[30] Foreign Application Priority Data

Jul. 16, 1979 [SE] Sweden ..... 7906128

[51] Int. Cl.[3] ..... B22F 3/00

[52] U.S. Cl. ..... 75/249; 75/226; 75/214; 75/138

[58] Field of Search ..... 75/249, 138, 226, 214

[56] References Cited

U.S. PATENT DOCUMENTS

| | | | |
|---|---|---|---|
| 2,963,780 | 12/1960 | Lyle et al. | 75/249 |
| 3,380,820 | 4/1968 | Hetke et al. | 75/249 |
| 3,383,208 | 5/1968 | Corral | 75/226 |
| 3,954,458 | 5/1976 | Roberts | 75/249 |
| 3,964,935 | 6/1976 | Wilks | 75/249 |

*Primary Examiner*—Brooks H. Hunt
*Attorney, Agent, or Firm*—Eric Y. Munson

[57] ABSTRACT

A wear resistant alloy of aluminium and an iron-based material. The alloy contains from 10% to 60% by volume of the iron-based material. The alloy has been created by very rapid surface heating of powder particles causing melting of the surface of the aluminium particles. The heating is produced by a shock wave pressure pulse. These surface regions are then very rapidly cooled by the rest of the particles so as to avoid chemical reactions between the aluminium particles and the particles of the iron-based material. The time at high temperature is of the order of a few microseconds at most.

8 Claims, 2 Drawing Figures

WEAR RESISTANT ALUMINIUM ALLOY

Figure 1:
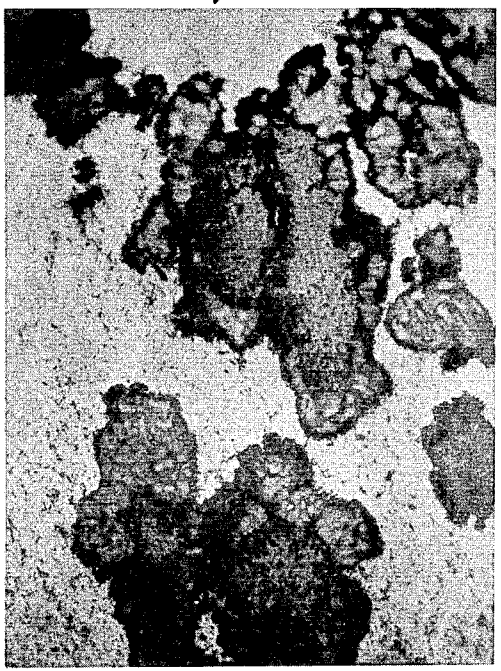

The present invention relates to a wear resistant alloy of aluminium and an iron-based material and a method of producing said alloy.

It has for a long time been a desire to add steel or cast iron, i.e. generally an iron-based material, to aluminium in order to obtain a light and wear resistant material. So far it has been impossible to obtain a satisfactory result when more than a few percent of iron-based material is added. The reason for this is that a chemical reaction creating a brittle intermetallic phase is obtained during the sintering when substantial amounts of steel or cast iron are added to the aluminium. In order to obtain a wear resistant material there should be at least 10% by volume of the iron-based material in the alloy, preferably at least 30%. It has up to now been impossible to produce such a material.

According to the present invention a new wear resistant alloy of aluminium, which could be in form of pure aluminium or a conventional aluminium alloy, and an iron-based material is created. This alloy comprises iron-based powder particles in a matrix of aluminium powder particles where the content of iron-based material is from 10% to 60% by volume. Particularly good results are obtained if there is from 20% to 60% of iron-based material. The alloy is further characterized by the special, previously unknown, type of interparticle bonds, which do not incorporate any brittle intermetallic phases. To the best of our knowledge the character of these bonds can only be defined indirectly by stating how they have been produced. It has been found that the chemical reactions creating the brittle intermetallic phases can be avoided if the interparticle bonds are created very rapidly. Typically the special bonds of the present invention are created within a few microseconds. In order to obtain these bonds a shock wave pressure pulse is propagated through the powder mixture . This pressure pulse has a rise time which is so short that only the surface regions of the aluminium particles are melted. In this way the particles are welded together into a strong solid body. Since this heating process is very rapid most of the material is left a room temperature during the heating process. Since the melted material is present only as thin layers on the particle surfaces these layers will be rapidly cooled by the rest of the material so that the above mentioned chemical reactions are avoided. The surface of the particles is at a high temperature for only a few microseconds at most.

The work introduced into the powder during the compaction is almost entirely taken up by the aluminium particles, the surface regions of which will flow around the particles of the iron-based material to fill any voids so as to form a solid body which will have density which is close to 100% of the theoretical density. In order to obtain this the pressure created by the shock wave should be of the order of 8 kbar or more.

The alloy according to the invention should preferably contain an iron-based material having a hardness of at least 30 HRc. In order to make the alloy strong the particles of the iron-based material should be at least as large as the aluminium particles and in order to obtain good abrasive wear resistance they should be several times larger. The aluminium should preferably be in form of a commercially pure aluminium or a conventional aluminium alloy, which must be capable of being heat treated at a temperature of less than 520° C., which is the temperature at which the chemical reactions causing the brittle intermetallic phases start. Such heat treatment increases strength and ductility of the solid body.

In order to obtain a good wear resistance, particularly regarding resistance against seizure, the type of iron-based material and the type of powder is of importance. Particularly good results have been obtained with powders of hardened tool steels and cast iron. Particularly good resistance against seizure is obtained if lead is added. Preferably there should be from 5% to 30% by volume of lead.

Five examples of aluminium alloys according to the invention are given below.

EXAMPLE 1

A volume of 60 $cm^3$ of a powder mixture comprising 80% by volume of commercially pure aluminium having a mean size of 100 μm and 20% by volume of tool steel with a mean size of 80 μm was placed in a 50 mm diameter compaction chamber on a bed of aluminium turnings. These turnings acting as a shock absorbing medium. a 2 mm thick plastic cover was placed on the powder mixture which then was lightly precompacted. A plastic piston of 60 mm length and 50 mm diameter was impacted at 1100 m/s on the powder. The alloy produced had a transverse rupture strength of 200 $MN/m^2$ and a macro hardness of 130 H.B. The wear resistance of the alloy approached that of low to medium alloy steels.

EXAMPLE 2

A volume of 100 $cm^3$ of a powder mixture comprising 50% by volume of commercially pure aluminium having a mean size of 100 μm and 50% by volume of tool steel having a mean size of 20 μm was placed in a 50 mm diameter compaction chamber as in example 1. A plastic piston of 100 mm length and 50 mm diameter was impacted at 1300 m/s on the powder. The alloy produced had a transverse rupture strength of 180 $MN/m^2$ and a macro hardness of 180 H.B. The wear resistance of the alloy was equivalent or superior to medium alloy steels for both abrasive and adhesive wear conditions.

EXAMPLE 3

A volume of 60 $cm^3$ of a powder mixture comprising 90% by volume of commercially pure aluminium having a mean size of 100 μm and 10% by volume of stainless steel with a mean size of 600 μm was placed in a 50 mm diameter compaction chamber as in example 1, but without precompaction. A plastic piston of 60 mm length and 50 mm diameter was impacted at 1100 m/s on the powder. The alloy produced had a transverse rupture strength of 300 $MN/m^2$ and a macro hardness of 80 H.B. The abrasive wear resistance of the alloy was particularly good.

EXAMPLE 4

A volume of 50 $cm^3$ of a powder mixture comprising 70% by volume of a conventional aluminium alloy, containing 1.6% Cu, 2.5% Mg and 5.6% Zn, having a mean size of 120 μm and 30% by volume of cast iron with a mean size of 200 μm was placed in a 50 mm diameter compaction chamber as in Example 1. Titanium piston of 60 mm length and 50 mm diameter was impacted at 800 m/s on the powder. The compacted powder was heat treated at 475° C. It was not subsequently aged. The alloy had a transverse rupture strength of 400 $MN/m^2$ and a macro hardness of 100

H.B. The wear resistance of the alloy approached that of low to medium alloy steels.

EXAMPLE 5

A volume of 170 $cm^3$ of a powder mixture comprising 70% by volume of commercially pure aluminium having a mean size of 100 μm and 30% by volume of tool steel with a mean size of 30 μm was placed in a 70 mm diameter compaction chamber on top of a steel rod acting as shock absorber. A 5 mm thick plastic cover was placed on the powder mixture. A plastic piston of 115 mm length and 70 mm diameter was impacted at 300 m/s on the powder. The compact was given a low temperature treatment at 300° C. The alloy then had a transverse rupture strength of 200 $MN/m^2$ and a macro hardness of 90 H.B. After heat treatment at 500° C. the ductility increased. The alloy had a transverse rupture strength of 160 $MN/m^2$ and a macro hardness of 55 H.B. The wear resistance of the alloy now approached that of low to medium alloy steels.

Figure 2:
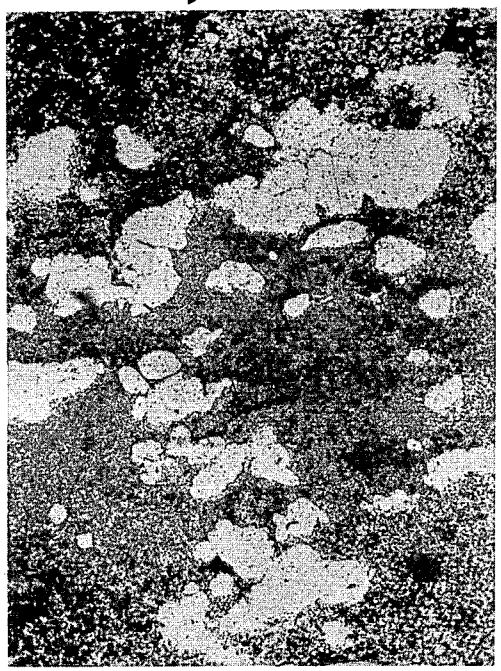

The enclosed FIG. 1 shows a micrograph of a mixture of aluminium and steel which has been pressed and then sintered at 530° C. for one hour. The brittle intermetallic phase obtained is clearly visible. FIG. 2 shows a micrograph of an alloy according to the present invention. No brittle phase is present in this case. In both Figures the size of the steel particles is about 120 μm.

I claim:

1. A wear resistant alloy of aluminium and iron-based material comprising iron-based powder particles in a matrix of aluminium powder particles, said powder particles being compacted, characterized thereby that the interparticle bonds have been produced by a shock wave pressure pulse, the rise time of which is sufficiently short to cause melting of the surface regions only of the aluminium particles whereby the particles are welded together into a strong solid body, said surface regions being rapidly cooled by the rest of the particles during the duration of said pressure pulse whereby chemical reactions between the iron-based and aluminium particles are avoided, and that the content of iron-based material is from 10% to 60% by volume.

2. A wear resistant alloy according to claim 1, characterized thereby that the iron-based particles have a hardness of at least 30 HRc.

3. A wear resistant alloy according to claim 1, characterized thereby that the iron-based particles are at least as large as the aluminium particles.

4. A wear resistant alloy according to claim 3, characterized thereby that the iron-based particles are several times larger than the aluminium particles.

5. A wear resistant alloy according to claim 1 characterized thereby that the aluminium particles comprise a commercially pure aluminium or a conventional aluminium alloy which is capable of being heat treated at a temperature of less than 520° C.

6. A wear resistant alloy according to claim 1, characterized thereby that the iron-based particles comprise hardened tool steel or cast iron.

7. A wear resistant alloy according to claim 1, characterized thereby that the content of iron-based based material is from 30% to 60% by volume.

8. A wear resistant alloy according to claim 5, characterized thereby that the alloy comprises lead, preferably from 5% to 30% by volume.

* * * * *